United States Patent [19]

Wilhelm

[11] 4,121,719

[45] Oct. 24, 1978

[54] HOLDER FOR WRITING INSTRUMENTS

[75] Inventor: Claus Wilhelm, Lahr, Fed. Rep. of Germany

[73] Assignee: The Parker Pen Company, Janesville, Wis.

[21] Appl. No.: 742,231

[22] Filed: Nov. 16, 1976

[30] Foreign Application Priority Data

Nov. 24, 1975 [DE] Fed. Rep. of Germany ... 7537302[U]

[51] Int. Cl.[2] ..... A47F 7/00

[52] U.S. Cl. ..... 211/69.5

[58] Field of Search ..... 206/270; 401/131; 15/435; 211/69.5, 69.1, 69.2, 69.4, 70

[56] References Cited

U.S. PATENT DOCUMENTS

| | | | |
|---|---|---|---|
| 1,092,156 | 4/1914 | Mathis | 211/69.1 X |
| 1,216,031 | 2/1917 | Wilcox | 206/270 |
| 2,637,299 | 5/1953 | Salkey | 211/69.5 X |

FOREIGN PATENT DOCUMENTS

| | | | |
|---|---|---|---|
| 1,078,829 | 11/1954 | France | 211/69.5 |

*Primary Examiner*—Roy D. Frazier
*Assistant Examiner*—Robert W. Gibson, Jr.

[57] ABSTRACT

A holder for pens has one part provided with a plurality of sets of pen-receiving sockets having a different number of sockets in each set and another part that can be positioned to expose for use any selected one of the sets. Another form provides the sets of sockets on different faces of a body so that the body may be positioned to direct any one of the sets in a desired direction of use.

3 Claims, 11 Drawing Figures

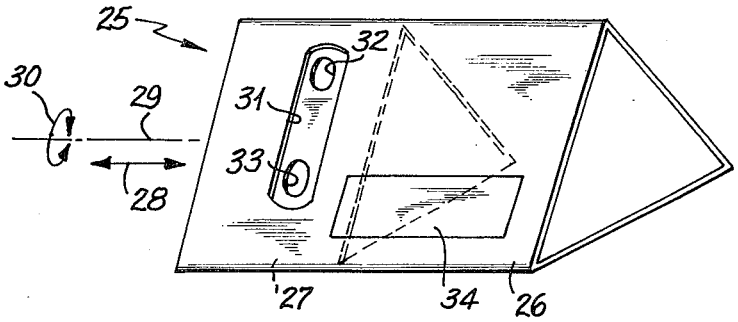
Fig. 6.
Fig. 7.
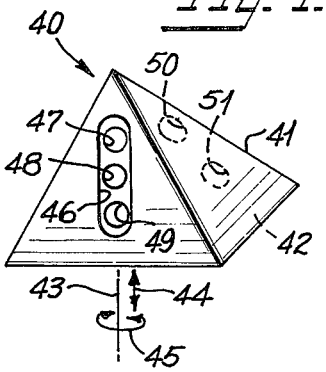
Fig. 8.
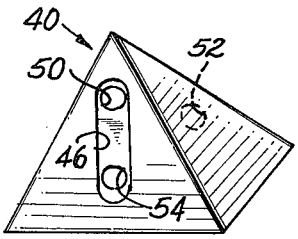
Fig. 9.
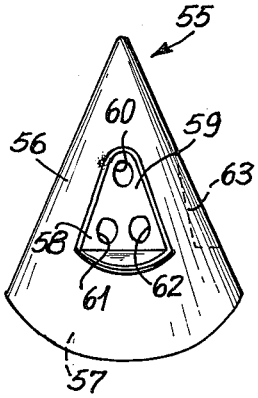
Fig. 10.
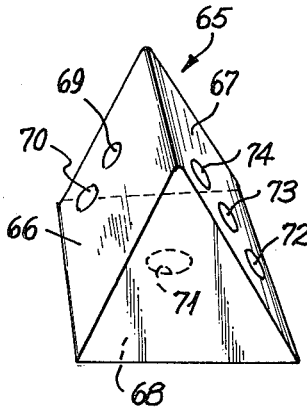
Fig. 11.
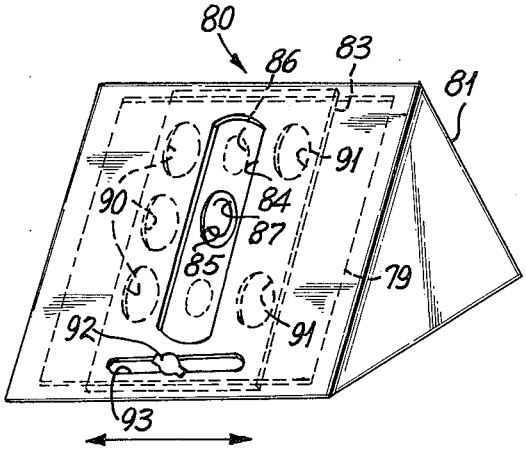

HOLDER FOR WRITING INSTRUMENTS

BACKGROUND OF THE INVENTION

The present invention relates to a holder for writing instruments, specifically for ballpoint pens, which comprises a main body having at least two sockets therein for holding the writing end of a writing instrument.

A large variety of such holders of different geometrical shapes and holding means are known. Usually such holders, especially holders for at least two writing instruments comprise a main body, the base of which can be placed on a solid support such as a desk or the like, and which has at least two sockets in a row, into which the writing ends of the writing instruments can be put. Frequently such holders are combined with other devices e.g., a plate for holding pencils, rubbers and the like.

In practice, the desires of various buyers differ from each other and therefore quite a number of such holders have to be kept in stock by the trade, that is, holders which are suited for only two writing instruments, for three writing instruments or for some other definite number of writing instruments. Quite often one of the writing instruments of a buyer's original set gets lost, so that then one of the recesses will always stay empty.

SUMMARY OF THE INVENTION

It is an object of the present invention to provide an improved holder for writing instruments of a simple and aesthetic shape and which can easily be produced at low costs.

It is a further object of the present invention to provide such a holder, which is easily usable for different purposes especially for holding different numbers of writing instruments.

It is a preferred object of the present invention to provide such a holder, which is equally suitable for different purposes without applying different exchangeable parts, more specifically a holder which can be adjusted for the desired number of writing instruments by the wholesale dealer or even the buyer himself.

In accomplishing the foregoing objects there is provided a holder for writing instruments, especially for ballpoint pens, a main body having at least two sets of different numbers of sockets for holding and fixing the writing ends of the writing instruments, which are movable into accessible position within said main body. Preferably the main body comprises at least two separate parts, the first of which has the sockets for holding the writing ends of the writing instruments and the second of which is a casing part, the two parts being movably connected to each other in such a way that, at the choice of the user, either one or two or three sockets can be moved into exposed position for use.

According to a preferred embodiment of the invention, the first part having the sockets is connected to the casing part in such a way that it can easily be exchanged.

In this way the wholesale dealer can easily change the holder in a simple manner according to the wishes of the clients, just by exchanging the part having the sockets, if it does not have the right number of sockets.

According to another embodiment of the invention, the parts are arranged in such a way that the part having the sockets and the casing part can be connected to each other in at least two different relative positions.

According to a further embodiment of the invention, the casing part has at least one window for exposure of any desired number of sockets. Covering and exposing of the sockets can also be done advantageously by means of a slide.

The holder can easily be produced at low cost. The separate parts are produced by injection molding, especially from plastic material, e.g., from impact resistance polystyrene. The changing of the position of the parts relative to each other can be done by the wholesaler, the retailer, or the buyer himself, always starting with the same device. No exchangeable parts or replacements have to be kept available. Nevertheless, the device has the same appealing closed shape in any position.

BRIEF DESCRIPTION OF THE DRAWINGS

FIG. 6 is a perspective view of another embodiment;

FIGS. 7 and 8 are views of still another embodiment in two different positions; and FIGS. 9, 10 and 11 are views of further embodiments.

DESCRIPTION OF THE PREFERRED EMBODIMENTS

FIGS. 1 to 5 show a preferred embodiment of the present invention. As can be seen from these figures, the cross section of this holder vertical to its base is an equilateral triangle. The holder is made of several parts, which are produced by injection molding, e.g. from impact resistant polystryene.

Figure 4:
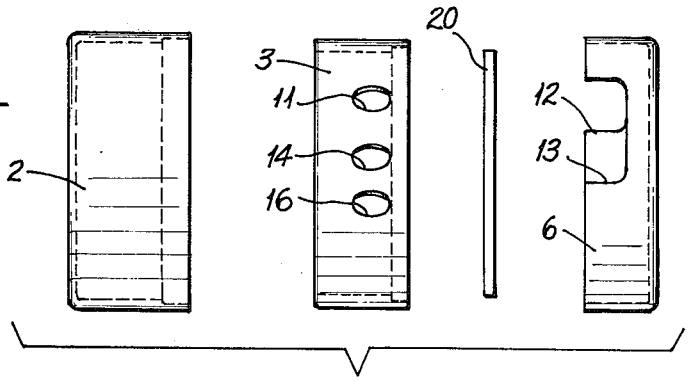
FIG. 4 is a drawing of the separate parts of which the holder of FIG. 1 is composed.
Figure 5:
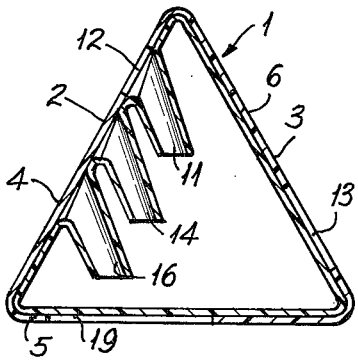
FIG. 5 is a cross section along the line I—I of FIG. 3.

As can be seen from FIG. 4, the holder 1 comprises a casing part 2 into which an insertion part 3 is firmly insertable. The insertion part, which is shaped as a tube with triangular profile has, near its right end in FIG. 4, three hollow sockets 11, 14, 16, extending inwardly and which taper towards the inside and which constitute the holding means for the writing ends of the writing instruments. In order to close the insertion part 3 at the front side near the sockets, a plate 20 is provided, which can be firmly inserted into the corresponding front end of the insertion part 3. The parts are arranged in such a way that upon inserting the insertion part 3 into the casing part 2, the section of part 3 which includes the sockets extends out of the casing part 2.

Figure 1:
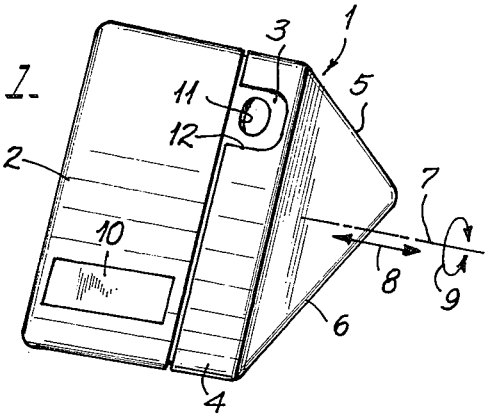
FIG. 1 is a perspective view of a holder comprising a preferred embodiment of the invention.
Figure 2:
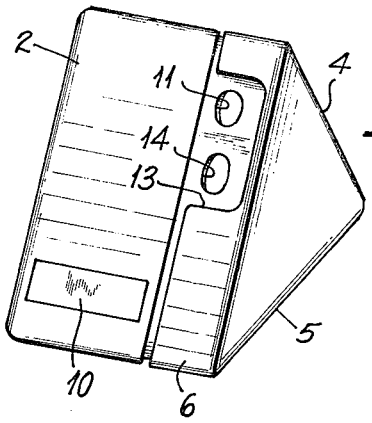
FIG. 2 is a perspective view of the holder of FIG. 1 but having the covering part turned into a different position.
Figure 3:
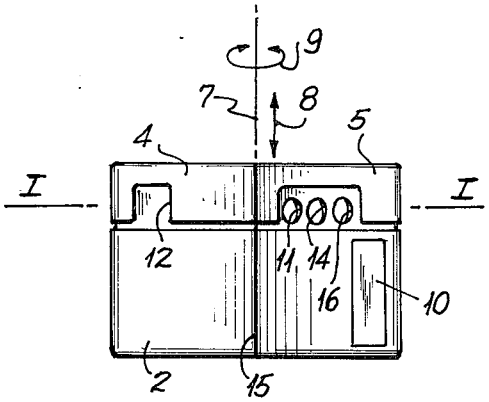
FIG. 3 is a top view of the holder of FIG. 1 having the covering part turned into a third position.

On the outwardly extending portion of the insertion part a covering part corresponding to the casing part 2 can be slid with a friction fit. This covering part has windows 12, 13, 19, which open respectively toward the edges on each of its three surfaces 4, 5, 6. By comparing the figures it is seen that these three windows have different lengths. Thus, the length of window 12 is sufficient to expose only socket 11 of insertion part 3 when the covering part is slid onto the extending portion of the insertion part 3, as can be seen in FIG. 1. Thus, FIG. 1 shows the holder in a condition in which it is suited for holding one single writing instrument. In order to make the holder of FIG. 1 usable for two writing instruments, the covering part may be removed from the position in FIG. 1 along the dotted line direction 7 as shown by arrow 8 and turned 120° around the axis 7 in the direction of arrow 9 and then slid back onto the insertion part 3. In this position the window 13 on the side surface 6 of the covering part exposes the sockets 11 and 14 in a position for use. In the same way the longest window 19 can be placed into using position by repeating the changing of the position of the covering part. Thus, all three sockets 11, 14, 16 may be exposed for use.

In order to provide a holder which provides a choice between one to four sockets, it is only necessary to provide for a quadratic cross section vertical to the base of the holder instead of the equilateral triangle, so that four sides of the square are available for placing four windows of different sizes.

It can be appreciated that the holder has an appealing shape and secure stand and that besides the sockets a surface is provided which can be used for other purposes, e.g., for supporting a calendar or advertisement, or decorations, ornaments, reliefs and the like.

Instead of using a movable covering part, the part having the sockets can be exchangeably connected to the casing part. In this case a set of 2, 3, or 4 exchangeable insertion parts has to be kept available for the same holder, whereby these exchangeable parts differ from each other only in the number of sockets.

Essentially the same advantages can be accomplished if the casing part has only one window and the isertion part is insertable into different positions and has different sets of different numbers of sockets on its surfaces which define the sides of the triangle.

In the embodiment of FIG. 6, the basic shape of the holder is essentially unchanged. The cross section of the tube shaped casing part 26 is an equilateral triangle and one end of a corresponding insertion part 27 is inserted into this casing part 26. The insertion part has on each of its three surfaces, which define the triangle, a set of sockets. FIG. 6 shows a holder 25 wherein the side of the insertion part which is in exposed position, exposes a set of two sockets 32 and 33. This position is determined by a window 31 on one of the sides of the casing part 26. In order to change the number of recesses, the inserting part 27 is removed from the casing part 26 in the direction of the line 29 according to the arrow 28 and turned 120° around the line 29 in the direction of the arrow 30 and is replaced in the casing part 26 in this position. In this embodiment as well the casing part 26 provides large exposed surfaces which are available for display purposes, as is schematically indicated by field 34.

In the embodiment of FIGS. 7 and 8, the holder has a pyramidical shape wherein the four-sided surface is the base of the holder. In this case there is provided a pyramidically shaped casing part 41 which has a window 46 on only one triangular surface. An equally pyramidical insertion part 42 is insertable from below into the casing part 41 in the direction of the axis 43. This insertion part has four sets of different numbers of sockets on its four triangular surfaces. Any of these sets of sockets can be aligned with the window 46 of the casing part 4 according to the position of the insertion part within the casing part. In the position shown in FIG. 7, the holder 40 exposes three sockets 47, 48, 49 through the window 46 for use. Changing only requires removing the insertion part 42 in the direction of the axis 43 downwards according to the arrow 44 turning it 90° around the axis in the direction of the arrow 45 and putting it back into the casing part. Thus, the two sockets 50, 51 are moved into exposed position through the window 46, whereas the remaining sets of sockets including the socket 52 which is shown by a dotted line in FIG. 8, are covered by the casing part 41.

In the holder 55 of FIG. 9, the same principle is used but the holder has a conical shape. Here as well the casing part 56 and the insertion part 57 have corresponding conical shapes and can be moved relatively to each other in the direction of the axis of the cone and can be turned rleative to each other around this axis, so that different sets of sockets can be aligned with the window 58 of the casing part. In the example shown, the insertion part has two flat surfaces 59, 63 interrupting its conical surface within the region of each of the sets of sockets. These flat surfaces ensure that the sockets 60, 61, 62 of the same set are parallel to each other. In those examples according to FIGS. 6 to 9 which are described above, the parts can, of course, also be arranged in such a way that the insertion part has only one set of a maximum number of the desired sockets whereas the casing part has windows of different sizes on its various surfaces, and these windows can each be aligned with the one set of sockets by changing the position of the parts relative to each other, whereby each window exposes a certain different number of sockets of this set.

In especially simple cases any of the simple basic geometric shapes, which were described above, can be used for the casing part, whereby sets of different numbers of sockets are provided on each of the pheripherical surfaces of the basic geometric body and are always exposed so that just by placing the body in a different position and using a different surface as the base a different set of sockets can be brought into a position suitable for the user.

In the holder 65 according to FIG. 10, the shape of the cross section is an equilateral triangle. Thus, the holder has three different peripheric surfaces 66, 67, 68. On each peripheric surface a set of sockets is provided. Thus, surface 66 has two sockets 69, 70. The surface 67 has a set of three sockets 72 to 74 whereas the surface 68 has only one socket 71.

In the position shown in FIG. 10, the surface 68 serves as the base of the holder. It is presumed that in FIG. 10 the left exposed surface of the triangle points into the using position. By moving the holder 65 onto one of the other two possible base surfaces 66, 67, the other sets of sockets, namely, the sets on the surfaces 67 or 68 can be placed in using position. This embodiment is especially simple, but it has the disadvantage that all sets of sockets are constantly exposed and by this the impression is lost, that the particular holder has been produced especially for the one definite purpose. The special advantage of the holder accordin to the before described embodiments is the fact that it can not easily be recognized that the same holder can be used for different purposes.

In the example shown in FIG. 11, the possibility of changing the holder for different numbers of sockets is also provided but the changing is effected in a slightly different way. Whereas in the embodiments according to FIGS. 1 to 9 a part comprising either several sets of sockets or several windows had to be turned into different positions relative to a second part, so that this turning part might be named a rotary slide, in the example according to FIG. 11 a flat slide which is movable in one plane is provided in order to effect the changing.

The holder 80 according to FIG. 11 comprises a casing part 81 which has the same preferable geometric shape as the casing part in FIG. 1.

Within the casing part 81 is provided an insertion part 79 which can be effected similarly to the insertion part 3 of FIGS. 1 to 5 and can comprise a set of three tapered sockets 86, 87, 88. The casing part 81 has a window 84 which is aligned with the three recesses in such a way that normally the window 84 exposes all three sockets at the same time. Yet between the insertion part 79 and the casing part 81 a flat slide 83 is placed, which is movable in the direction of the double arrow and which has three sets of apertures close to each other which can be aligned with the window 84 of the casing part by moving the slide 83. In the position shown in FIG. 11, the aperture 85 of the slide is in alignment with the socket 87 of the insertion part 79 and the window 84 of the casing part 81. Thus, the holder is usuable for one ball pen. By means of an appendage 92 of the slide 83 which extends outwardly through a slot 93 in the casing part 81, the slide can be moved into the other two positions wherein either the set of apertures 90 or the set of apertures 91 are aligned with the window 84 of the casing in order to expose two or three sockets of the insertion part.

The described embodiments of the invention show holders, the base surface of which can be placed on a plane horizontal support as is usually done. But, the invention can also be used for holders which are fixed in another way, e.g., are fixed by means of a suction cup or a magnetic button on a vertical surface.

I claim:

1. A holder for writing instruments especially for ballpoint pens comprising:

a main body provided with a plurality of hollow sockets extending inwardly of the body and tapering toward the inside of each socket for unassistedly holding and fixing the writing ends of said writing instruments, and a relatively movable casing portion, said casing portion being movable to different positions with respect to said main body and having at least two windows of different sizes to completely expose selected ones of the sockets for use, wherein by the windows having different sizes a selected number of sockets are exposed for use.

2. The holder according to claim 1 wherein the main body and the casing portion both have a tube-shaped peripheric surface, on which the sockets and windows respectively are placed and both parts can be moved relatively of each other along their common axis and can be turned relative to each other about this axis.

3. The holder according to claim 2 wherein the tube-shaped portion has a cross section of an equilateral triangle.

* * * * *